US007025431B2

(12) United States Patent
Ikeda et al.

(10) Patent No.: US 7,025,431 B2
(45) Date of Patent: Apr. 11, 2006

(54) RECORDING APPARATUS

(75) Inventors: Yasuhiko Ikeda, Kanagawa (JP); Seiji Takahashi, Kanagawa (JP); Kota Uchida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 10/626,536

(22) Filed: Jul. 25, 2003

(65) Prior Publication Data

US 2004/0155923 A1 Aug. 12, 2004

(30) Foreign Application Priority Data

Aug. 9, 2002 (JP) ..... 2002-233062

(51) Int. Cl.
*B41J 3/00* (2006.01)
*B41J 2/165* (2006.01)

(52) U.S. Cl. ..... 347/4; 347/27

(58) Field of Classification Search ..... 347/4, 347/27, 94; 400/319

See application file for complete search history.

(56) References Cited

U.S. PATENT DOCUMENTS 6,793,303 B1 * 9/2004 Ikeda ..... 347/4

FOREIGN PATENT DOCUMENTS

JP 6-47978 2/1994

* cited by examiner

*Primary Examiner*—Shih-wen Hsieh

(74) *Attorney, Agent, or Firm*—Fitzpatrick, Cella, Harper & Scinto

(57) ABSTRACT

A recording apparatus for effecting recording on a recording medium by a recording head includes a carriage for reciprocally scanning with the recording head carried thereon, a guide member for guiding the reciprocal scanning of the carriage, a drive source for driving the reciprocal scanning of the carriage, a transmitting member for transmitting a driving force from the drive source to the carriage, a holding member for holding the transmitting member, a projected portion disposed on the carriage and having the holding member mounted thereon, and an attenuating member for attenuating vibrations from the drive source between the carriage and the holding member, the attenuating member being of a shape surrounding the projected portion of the carriage, and the holding member holding the transmitting member being mounted on the projected portion with the attenuating member interposed therebetween.

8 Claims, 5 Drawing Sheets

RECORDING APPARATUS

BACKGROUND OF THE INVENTION

1. Field of the Invention

The invention relates to a recording apparatus for effecting recording on a recording medium by a recording head.

2. Description of Related Art

A recording apparatus having the functions of a printer, a copying machine, a facsimile apparatus, etc., or a recording apparatus used as the output apparatus of compound type electronic apparatus or a work station including a computer, a word processor, etc., has such a construction that can record an image on a recording material (recording medium) such as paper or a plastic thin sheet on the basis of image information. Such recording apparatuses can be grouped into an ink jet type, a wire dot type, a thermal type, a laser beam type, etc., depending on its recording method.

In a recording apparatus of a serial type adopting a serial scanning method of main-scanning in a direction intersecting with the conveyance direction (sub-scanning direction) of a recording material, the operation of an image being recorded (main-scanned) by recording means carried on a carriage moved along the recording material, and the conveyance (pitch conveyance) of the recording material being effected in a predetermined amount of feeding after the recording of one line has been finished is repeated, whereby recording on the entire recording material is accomplished. On the other hand, in a recording apparatus of a line type for recording by only sub-scanning in the conveying direction of a recording material, the operation of setting the recording material at a predetermined recording position, collectively effecting the recording of one line, and thereafter effecting the conveyance (pitch conveyance) of the recording material in a predetermined amount of feeding, and further collectively effecting the recording of the next line is repeated, whereby recording on the entire recording material is accomplished.

Of the above-described recording apparatuses, the recording apparatus of the ink jet type (ink jet recording apparatus) using the serial scanning method effects recording by discharging ink from recording means (a recording head) to the recording material, and has the merits that the compactness of the recording means is easy to realize, and the apparatus can record highly definite images at a high speed, can record on plain paper without subjecting the paper to special treatment, is low in running cost, suffers little from noise because it is of a non-impact type, and can easily record a color image by the use of inks of multiple colors.

Particularly, as regards the recording means (recording head) of the ink jet type utilizing thermal energy to discharge ink, by forming a film-shaped electro-thermal conversion member, an electrode, a liquid path wall, a top plate, etc. on a substrate by way of semiconductor manufacturing processes such as etching, vapor deposition and sputtering, one having a highly dense liquid path arrangement (discharge port arrangement) can be manufactured easily, and further compactness can be achieved.

In recent years, requirements for the quality of the recording material have become various, and recording not only on paper and resin sheets (such as OHP) which are ordinary recording materials, but also on thin paper and processed paper (perforated paper for filing, paper of any shape, etc.) has come to be required.

To obtain sharp-cut recording of a high quality in the above-described ink jet recording apparatus, it is very important to stabilize the behavior of the carriage in case of serial scanning.

As an ordinary carriage scanning mechanism of the serial scanning type, a carriage is slidably mounted by a guide rail and is engaged with a toothed belt passed over a pair of toothed timing pulleys, and the toothed timing pulleys are driven by a motor to thereby reciprocally scan the carriage. In a driving method by such a belt, the belt is shaken by the vibration of a motor which is a drive source for the carriage, or the belt is shaken by vibrations occurring when the toothed timing pulleys and the belt come into meshing engagement with each other. This shaking, if the carriage is firmly fixed, may sometimes be transmitted even to the recording head carried on the carriage. Also, the carriage may sometimes be vibrated by a sudden speed change during the reversal of reciprocation or during starting when the carriage is scanned. These make the behavior of the carriage unstable and therefore cause faulty printing or cause the production of noise such as the resonance of parts incorporated in the carriage.

Therefore, in the conventional construction, there is used a construction in which an elastic member is disposed between the belt or a member holding this belt and the carriage so that the degree of freedom of the carriage with respect to the scanning direction thereof may become high, thereby attenuating the vibration during the reversal of the carriage and the meshing vibration of the belt.

In the above-described example of the conventional art, however, the phase deviation between the motor, which is the drive source, and the carriage becomes great because the degree of freedom of the carriage with respect to the scanning direction thereof is made high, and as a result, the following problems arise:

(1) a reduction in response when the motor is started for the carriage scanning;

(2) the vibration of the carriage when the carriage is driven; and (3) the deviation of the stopped position of the carriage.

The above-mentioned problems (1) to (3) not only lower the stability of the operation of the carriage, but also cause an increase in the total recording time (reduces throughput) because it becomes necessary to lower the scanning speed of the carriage in order to stabilize the operation of the carriage. Particularly, this is not suitable for the higher speed of printers in recent years, and leads to a construction in which the compatibility of the quality of recorded images and the recording speed is difficult.

SUMMARY OF THE INVENTION

It is the object of the present invention to provide a connecting structure for a carriage and a driving belt in a serial scan type recording apparatus in which the phase deviation between a motor and the carriage is small and vibrations to be attenuated can be effectively suppressed.

The present invention provides a recording apparatus for effecting recording on a recording medium by a recording head, having a carriage for reciprocally scanning with the recording head carried thereon, a guide member for guiding the reciprocal scanning of the carriage, a drive source for driving the reciprocal scanning of the carriage, a transmitting member for transmitting a driving force from the drive source to the carriage, a holding member for holding the transmitting member, a projected portion disposed on the carriage and having the holding member mounted thereon, and an attenuating member for attenuating vibrations from the drive source between the carriage and the holding member, wherein the vibration attenuating member is of a shape surrounding the projected portion, and the holding member holding the transmitting member is mounted on the projected portion with the attenuating member interposed therebetween.

According to the present invention, the vibration can be suppressed by only the compressive force of the attenuating member and therefore, of the vibrations from the drive source, it is easy to attenuate a vibration of a frequency to be attenuated. Also, the degree of freedom is secured by only the compression allowance of the attenuating member and therefore, it is difficult for phase deviation to occur with respect to the scanning direction of the carriage. Therefore, the response when the carriage is started is good and it is difficult for the deviation of the stopped position of the carriage to occur.

Also, according to the present invention, the holding member and the projected portion of the carriage overlap each other with respect to the scanning direction of the carriage, and the holding member and the attenuating member, and the projected portion of the carriage and the attenuating member are substantially in fitted relationship with each other, whereby the effect of suppressing the vibrations of the carriage can be heightened.

Also, according to the present invention, the holding member and the projected portion of the carriage overlap each other with respect to the projecting direction of the projected portion, and the holding member and the attenuating member, and the projected portion of the carriage and the attenuating member are substantially in fitted relationship with each other, whereby the effect of suppressing the vibrations of the carriage can be heightened.

Also, according to the present invention, the recording apparatus further has a mounting member for mounting the holding member on the carriage, and the mounting member does not contact with the carriage, but operates integrally with the holding member, whereby the carriage and the holding member can be reliably mounted without hampering the vibration attenuating effect.

In this construction, the vibration attenuating member is sandwiched between the holding member and the mounting member and therefore, the reliability of the mounting of the holding member and the vibration attenuating effect can be improved.

Also, according to the present invention, the attenuating member between the holding member and the projected portion of the carriage is compressed in advance in the scanning direction of the carriage, whereby the vibrations of the carriage with respect to the scanning direction of the carriage can be suppressed more effectively.

Also, according to the present invention, a plurality of convex portions are provided on a side of the projected portion of the carriage in the scanning direction of the carriage, and the attenuating member between the holding member and the projected portion of the carriage is adapted to mesh with the convex portions provided on the side of the carriage in the scanning direction thereof on the projected portion of the carriage, whereby the degree of freedom in the direction of rotation about the projected portion of the carriage can be regulated without hampering an assembling property.

DETAILED DESCRIPTION OF THE PREFERRED EMBODIMENTS

Some embodiments of the present invention will hereinafter be described with reference to the drawings.

(First Embodiment)

Figure 1:
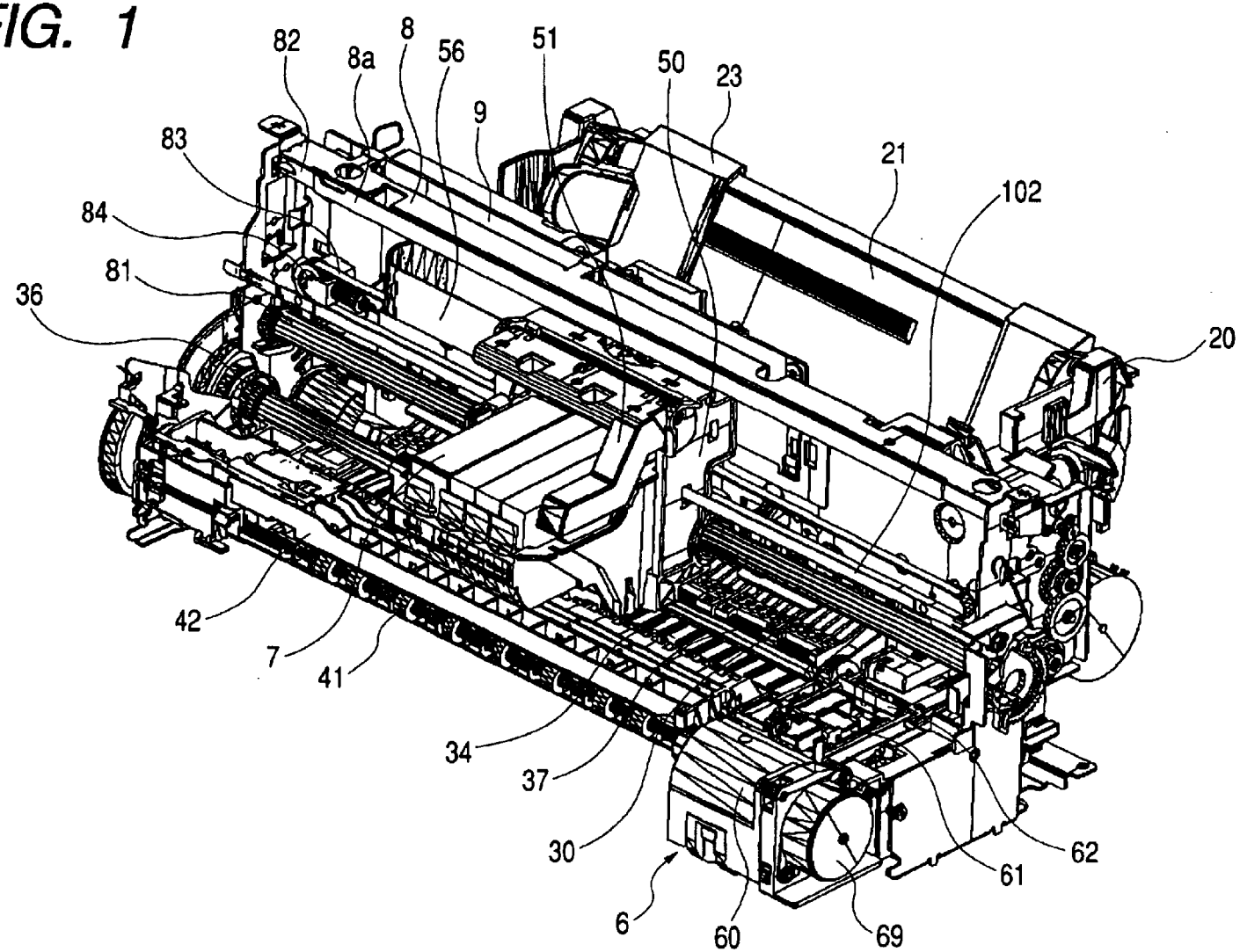
FIG. 1 is a perspective view showing the general construction of a recording apparatus according to an embodiment suitable for the present invention.
Figure 2:
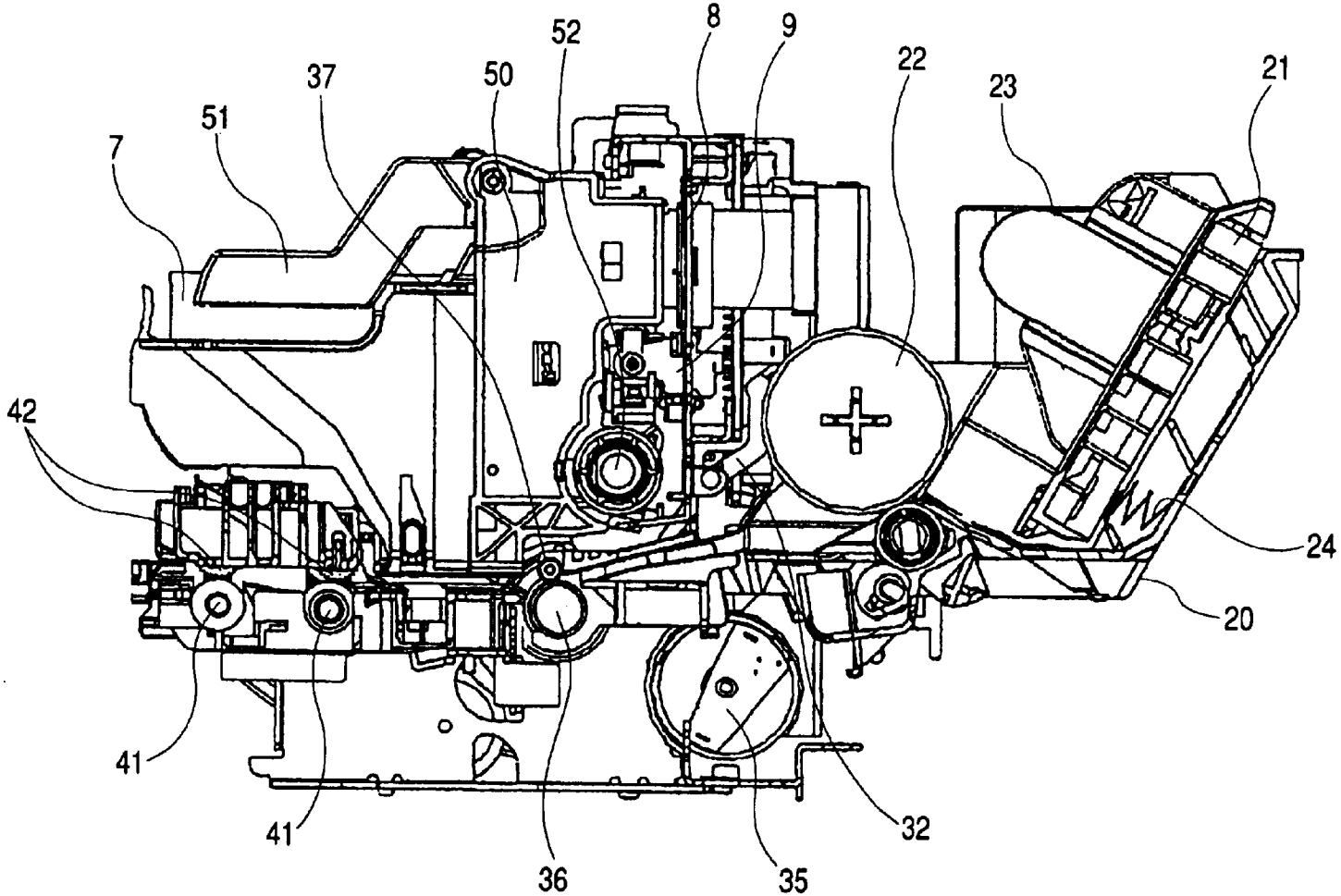
FIG. 2 is a side cross-sectional view of the recording apparatus shown in FIG. 1.

The structure of the recording apparatus of the present invention is first schematically shown in FIGS. 1 and 2. FIG. 1 is a perspective view showing the general construction of a recording apparatus according to an embodiment suitable for the present invention, and FIG. 2 is a side cross-sectional view of the recording apparatus.

The recording apparatus 1 of the form shown in FIG. 1 is an ink jet recording apparatus of a serial scan type, and comprises a sheet feeding portion having an automatic feeder, a sheet conveying portion, a sheet discharging portion, a carriage portion 5 and a cleaning portion 6. These will be divided into items and will be schematically described in succession. Also, while in the present embodiment, description will be made with the ink jet recording apparatus taken as an example, the present invention is not restricted to the ink jet recording type, but can be applied to any recording apparatus of the serial scan type. Also, while for the convenience of description, paper is taken as an example of a recording material, the present invention is not restricted thereto.

(A) Sheet Feeding Portion

In FIGS. 1 and 2, the sheet feeding portion has a construction in which a pressure plate 21 for stacking recording sheets thereon and a feeding rotary member 22 for feeding the recording sheets are mounted on a base 20. A movable side guide 23 is movably provided on the pressure plate 21 and regulates the stacked position of the recording sheets. The pressure plate 21 is rotatable about a shaft coupled to the base 20, and is biased toward the feeding rotary member 22 by a pressure plate spring 24.

(B) Sheet Conveying Portion

The sheet conveying portion has a conveying roller 36 for conveying the recording sheets and a PE sensor 32. A driven pinch roller 37 is provided in contact with the conveying roller 36. The pinch roller 37 is held on a pinch roller guide 30 and is brought into pressure contact with the conveying roller 36 by a pinch roller spring to thereby create a conveying force for the recording sheets. Further, a platen 34 for guiding the recording sheets is disposed at the entrance of the sheet conveying portion to which the recording sheets are conveyed. Also, the pinch roller guide 30 is provided with a PE sensor lever 35 for transmitting the detection of the leading edge and trailing edge of the recording sheet to the PE sensor (sheet edge detecting portion) 32. Further, downstream of the conveying roller 36 with respect to the conveying direction of the recording sheet, there is provided a head cartridge 7 for forming an image on the basis of image information.

In the above-described construction, the recording sheet fed to the sheet conveying portion is guided by the platen 34, the pinch roller guide 30 and an upper guide 33 and is sent to a pair of conveying roller 36 and pinch roller 37. At this time, the PE sensor lever 35 detects the leading edge of the recording sheet conveyed thereto, thereby binding the recording position of the recording sheet. Also, the recording sheet is conveyed on the platen 34 by the pair of conveying roller 36 and pinch roller 37 being rotated by an LF motor (not shown).

In this case, as the head cartridge 7, use is made of an ink jet recording head, which enables an ink tank to be interchanged. This head cartridge 7 can impart heat to ink by a heater or the like. The ink is film-boiled by the heat, and the ink is discharged from the nozzle of the head by a pressure change caused by the growth or contraction of a bubble by this film boiling, and an image is formed on the recording sheet. While the head cartridge 7 in the present embodiment adopts a method of discharging the ink by thermal energy, the present invention is not restricted thereto, but use may be made of a method of discharging the ink by the utilization of vibration energy, magnetic field energy or the like.

(C) Carriage Portion

The carriage portion 5 has a carriage 50 on which the head cartridge 7 is interchangeably mounted by the pivotal movement of a carriage lever 51. The carriage 50 is supported by a guide shaft 81 for reciprocally scanning the carriage in a direction intersecting with, preferably perpendicular to, the conveying direction of the recording sheet, and a guide rail 82 for holding the rear end of the upper portion of the carriage 50 to thereby regulate the rotating-operation of the carriage 50 relative to the guide shaft 81, and also maintaining the gap between the recording head 7 and the recording sheet. Guide means such as the guide shaft 81 and the guide rail 82 are mounted on a chassis 8. Also, a regulating portion 8*a*, which provides the regulation of the range of the leftward movement of the carriage 50 relative to the front of the recording apparatus 1 is bent up on the chassis 8.

The carriage 50 is driven by a carriage motor mounted on the chassis 8 through a timing belt 83. This timing belt is stretched around and supported by an idle pulley 84. Further, the carriage 50 is provided with a flexible cable 56 for transmitting a head signal from an electric substrate 9 to the cartridge head 7. Also, a linear encoder for detecting the position of the carriage 50 is carried on the carriage 50, and can read the number of lines on a linear scale 102 mounted on the chassis 8 to thereby detect the position of the carriage. The signal of this linear encoder is transmitted to and processed by the electric substrate 9 through the flexible cable 56.

In the above-described construction, when an image is to be formed on the recording sheet, the pair of conveying roller 36 and pinch roller 37 convey the recording sheet to a column position for forming an image (a position in the conveying direction of the recording sheet), and also move the carriage 50 to a row position for forming an image (a position perpendicular to the conveying direction of the recording sheet) to thereby oppose the head cartridge 7 to an image forming position. Thereafter, by a signal from the electric substrate 9, the head cartridge 7 discharges an ink drop toward the recording sheet, whereby an image is formed thereon.

(D) Sheet Discharging Portion

In the sheet discharging portion, a spur 42, which is a rotary member driven to rotate by a sheet discharging roller 41 is brought into contact with the sheet discharging roller 41. By the above-described construction, the recording sheet on which an image has been formed by the carriage portion 5 is conveyed while being nipped between the sheet discharging roller 41 and the spur 42 and is discharged to a sheet discharging tray (not shown) or the like.

(E) Cleaning Portion

The cleaning portion 6 is comprised of a cap 61 for suppressing the desiccation of the nozzle portion of the head cartridge 7, a pump 60 for sucking out the ink or the like in the nozzle portion to thereby effect cleaning with a surface (face), in which the nozzle portion of the head cartridge 7 is formed, being hermetically sealed by the cap 61, a wiper 62 for cleaning the face of the head cartridge 7, and a pulse motor (PG motor) 69, which is a drive source. The cleaning portion 6 is installed outside an area in which the recording material is recorded, and is designed such that when the carriage 50 is moved to this area and the head cartridge 7 has arrived there, the cap 61 is moved relative to the face and in operative association with such movement of the carriage, the wiper 62 abuts against the face, which is thus wiped.

Description will now be made of the details of the carriage portion according to the present invention.

Figure 3:
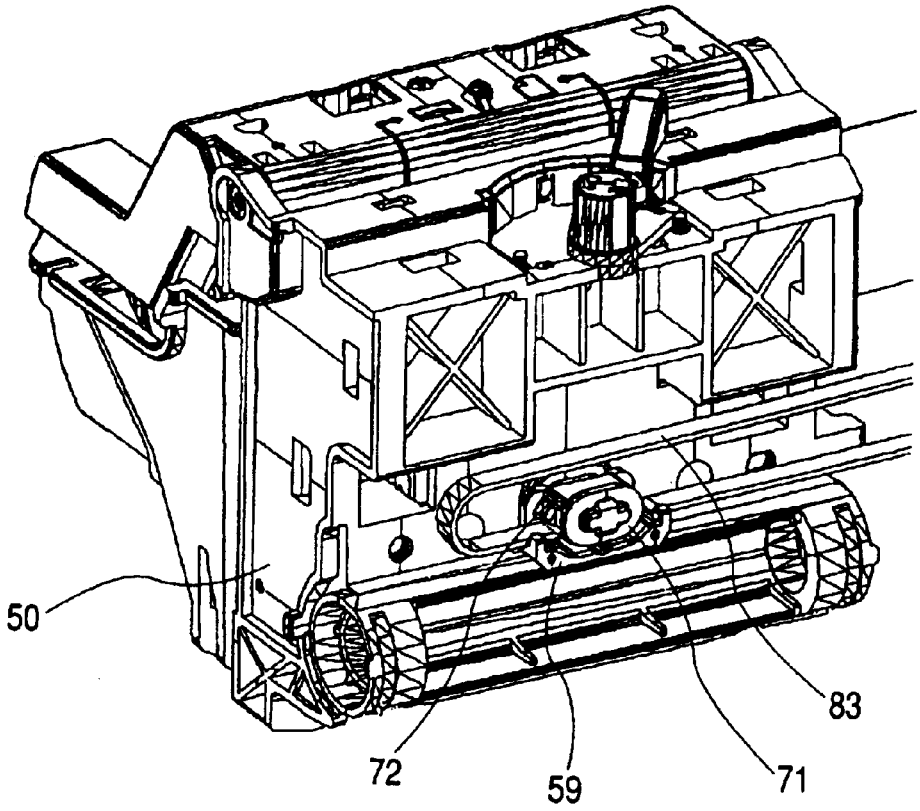
FIG. 3 is a perspective view of the carriage portion of the recording apparatus shown in FIG. 1 as it is seen from its back.

FIG. 3 is a perspective view of the carriage portion 5 of the above-described recording apparatus 1 as it is seen from its back. Referring to FIG. 3, on the back side of the carriage 50, a belt holder 59 is fixed while nipping the timing belt 83 so as not to suffer from any phase deviation with respect to the timing belt 83. A damper 71 which is an elastic member for attenuating vibrations from a driving system and making the transmission of the vibration to the carriage 50 difficult is directly fixed to the back of the carriage 50, and the belt holder 59 is mounted by a mounting member 72 through this damper 71.

Figure 4:
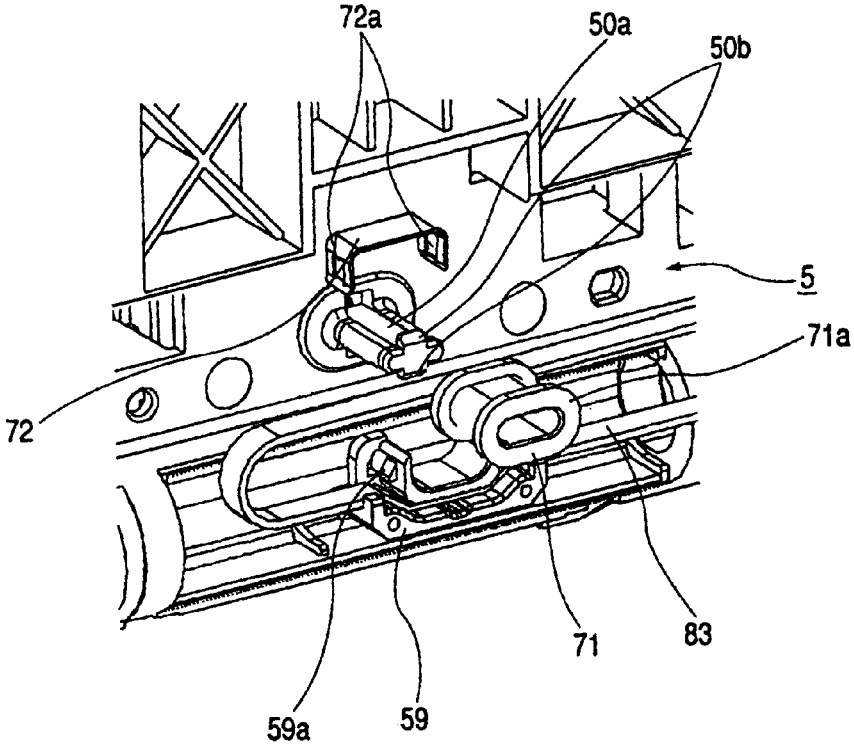
FIG. 4 shows a state in which certain parts have been detached from the back of the carriage to show portions concerned in the drive transmission of the carriage portion shown in FIG. 3.

FIG. 4 shows a state in which certain parts have been detached from the carriage 50 in order to show that portion of the carriage portion 5 that is concerned in drive transmission. As previously described, a driving force from the carriage motor is transmitted to the carriage portion 5 through the timing belt 83, which is transmitting means therefor. The damper 71 is interposed between the belt holder 59, which is holding means firmly held with the timing belt 83 nipped, and the carriage portion 5, and the materials of these components have the effect of attenuating a vibration of a frequency to be attenuated, of the vibrations from the drive source (hereinafter referred to as the "vibration attenuating effect"). The constructions of the damper 71, etc., will now be described.

In FIG. 4, the substantially cylindrical damper 71 is fitted onto the projected portion 50*a* of the carriage 50. At this time, the distal end of the projected portion 50*a* has its pawl portions 50*b* protruded in the vertical direction of the carriage 50 and therefore, the damper 71 fitted onto the projected portion 50*a* is held so as not to slip off. Also, the hole of the damper 71 fitted onto the projected portion 50*a* is of an elliptical shape, and the projected portion 50*a* of the carriage 50 also has an outer peripheral shape of which the transverse cross-section is substantially elliptical, and the inner dimension of the elliptical hole of the damper 71 and the outer dimension of the projected portion 50*a* of the carriage 50 are substantially the same dimensions.

Next, the belt holder 59 is inserted from the lower portion of the outer side of the damper 71. The belt holder 59 and the projected portion 50*a* of the carriage 50 overlap each other with respect to the scanning direction of the carriage 50 and the protruding direction of the projected portion 50*a*. Also, the belt holder 59 is formed with a concave portion into which the damper 71 is fitted. The configurational width of the damper 71 corresponding to the scanning direction of the carriage (except the flange portion 71*a* of the damper 71) is the same dimension as the width on the inner side of the concave portion of the belt holder 59 in the scanning direction of the carriage, and the degree of freedom between the belt holder 59 and the carriage 50 in the scanning direction of the carriage is secured by compressing the thickness of the damper 71 with respect to the scanning direction of the carriage.

Lastly, the mounting member 72 is mounted on the belt holder 59. Pawl portions 59*a* are provided on the opposite sides of the belt holder 59 correspondingly to apertures 72*a* formed in the opposite sides of the mounting member 72 and therefore, at this time, the pawl portions 59*a* and the apertures 72*a* come into engagement with each other. In this state, there is provided a construction in which the damper 71 is sandwiched so as to be enclosed by the mounting member 72 and the belt holder 59 without any gap, and the mounting member 72 and the carriage 50 do not contact each other, but operate integrally with the belt holder 59. Therefore, vibrations produced from the carriage motor and the timing belt 83 are transmitted without fail to the carriage portion 5 through the damper 71, and the vibration attenuating effect can be sufficiently obtained.

Also, the damper 71 and the projected portion 50*a* of the carriage 50, and the damper 71 and the belt holder 59 are equal to each other in dimension with respect also to the depth direction (sheet conveying direction) in FIG. 4 and therefore, with respect also to this direction, the degree of freedom is secured by only the compressible amount (compression allowance) of the damper 71.

As described above, in the construction wherein the driving force from the drive source is transmitted to the carriage 50 through the damper 71, the damper 71, which is a vibration attenuating member, is inserted onto the projected portion 50*a* of the carriage 50 and the damper 71 is mounted without any gap so as to be enclosed by the belt holder 59 and the mounting member 72, whereby the vibration attenuating effect can be provided by only the compressive force of the damper 71, and the degree of freedom is secured by only the compression allowance of the damper 71 and therefore, it is difficult for phase deviation to occur in the scanning direction of the carriage. Therefore, the response when the carriage 50 is started is good, and it is difficult for the deviation of the stopped position of the carriage 50 to occur.

(Second Embodiment)

A second embodiment of the present invention will now be described with respect to its difference from the first embodiment.

Figure 5:
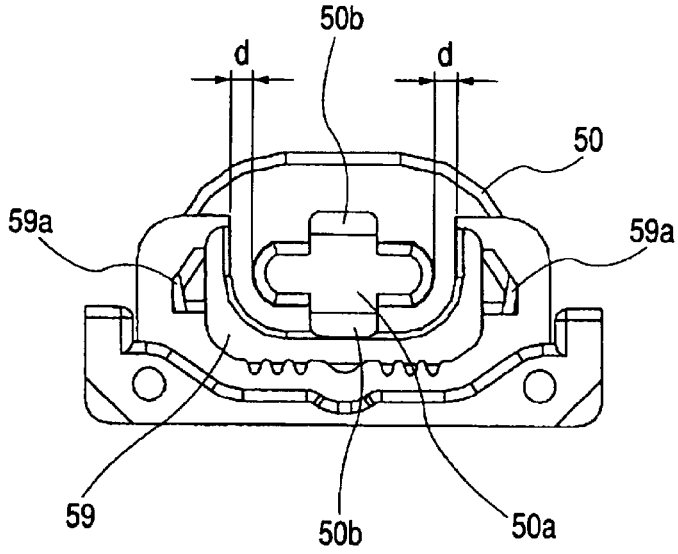
FIG. 5 shows portions concerned in the drive transmission of a carriage portion in a second embodiment of the present invention.

FIG. 5 shows that portion of a carriage portion in the second embodiment of the present invention, which is concerned in drive transmission. However, FIG. 5 represents only the projected portion 50*a* of the carriage 50 and the belt holder 59 shown in FIGS. 3 and 4, and does not show the damper 71 and the timing belt 83.

In the present embodiment, as shown in FIG. 5, the design gap "d" between the projected portion 50*a* of the carriage 50 and the belt holder 59 in the scanning direction of the carriage is made smaller than the thickness "t" of the damper 71. According to the present embodiment, there is realized such a dimensional relation that the damper 71 is compressed in advance, and the oscillation of the carriage with respect to the scanning direction of the carriage can be suppressed more effectively.

(Third Embodiment)

A third embodiment of the present invention will now be described with respect to its differences from the first embodiment.

Figure 6:
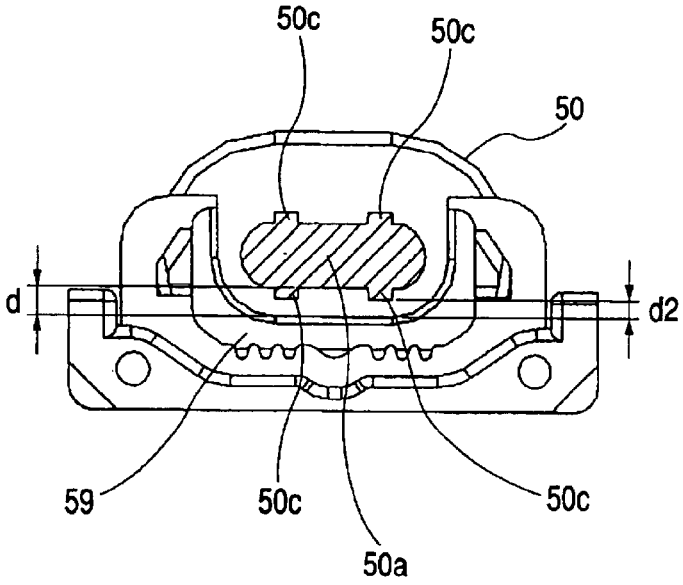
FIG. 6 shows portions concerned in the drive transmission of a carriage portion in a third embodiment of the present invention.

FIG. 6 shows a portion of a carriage portion in the third embodiment of the present invention, which portion is concerned in drive transmission. Hatchings in FIG. 6 represent a cross-section.

As described in the first embodiment, in the connecting structure for the carriage portion and the timing belt, the driving force from the carriage motor is transmitted to the belt holder 59 through the timing belt 83, and is further transmitted from the belt holder 59 to the damper 71 and the carriage 50. In this form, a force, which rotates the belt holder 59, is applied during the start.

As a countermeasure for this, as shown in FIG. 6, convex portions 50*c* are provided at two locations along the scanning direction of the carriage on each of two upper and lower sides of the projected portion 50*a* of the carriage 50, which convex portions are covered with the inner side of the damper 71.

In the whole gap "d" between the belt holder 59 and the projected portion 50*b* of the carriage 50 in which the damper 71 intervenes, a minimum interval at the locations of the convex portions 50*c* is defined as "d2", and the relation thereof with the thickness "t" of the damper 71 is defined as $d2<t\leqq d$. According to this dimensional relation, the damper 71 between the head holder 59 and the projected portion 50*a* of the carriage 50 is in meshing engagement with the convex portions 50*c* provided on the side of the projected portion 50*a* of the carriage 50 in the scanning direction of the carriage 50, and can therefore regulate the degree of freedom in the direction of rotation about the projected portion 50*a*. Also, since the whole gap "d" is not made small, a compressive force produced during assembly is small and the assembling property is not diminished.

What is claimed is:

1. A recording apparatus for effecting recording on a recording medium by a recording head, said recording apparatus comprising:

a carriage for reciprocally scanning with the recording head carried thereon;

a guide member for guiding the reciprocal scanning of said carriage;

a drive source for driving the reciprocal scanning of said carriage;

a transmitting member for transmitting a driving force from said drive source to said carriage;

a holding member for holding said transmitting member;

a projected portion disposed on said carriage and having said holding member mounted thereon; and an attenuating member for attenuating vibrations from said drive source between said carriage and said holding member, said attenuating member being of a shape surrounding said projected portion of said carriage, and said holding member holding said transmitting member being mounted on said projected portion with said attenuating member interposed therebetween.

2. A recording apparatus according to claim 1, wherein said holding member and said projected portion overlap each other with respect to a scanning direction of said carriage, and said holding member and said attenuating member, and said attenuating member and said projected portion are substantially in fitted relationships with each other.

3. A recording apparatus according to claim 1, wherein said holding member and said projected portion overlap each other with respect to a protruding direction of said projected portion, and said holding member and said attenuating member, and said attenuating member and said projected portion are substantially in fitted relationships with each other.

4. A recording apparatus according to claim 1, further comprising a mounting member for mounting said holding member on said carriage, wherein said mounting member does not contact with said carriage, but operates integrally with said holding member.

5. A recording apparatus according to claim 4, wherein said attenuating member is sandwiched between said holding member and said mounting member.

6. A recording apparatus according to claim 1, wherein said attenuating member disposed between said holding member and said projected portion is compressed in advance in a scanning direction of said carriage.

7. A recording apparatus according to claim 1, wherein said projected portion has a plurality of convex portions on a side thereof in a scanning direction of said carriage.

8. A recording apparatus according to claim 7, wherein said attenuating member disposed between said holding member and said projected portion is in meshing engagement with said convex portions.

* * * * *

UNITED STATES PATENT AND TRADEMARK OFFICE

CERTIFICATE OF CORRECTION

PATENT NO. : 7,025,431 B2
APPLICATION NO. : 10/626536
DATED : April 11, 2006
INVENTOR(S) : Yasuhiko Ikeda et al.

It is certified that error appears in the above-identified patent and that said Letters Patent is hereby corrected as shown below:

COLUMN 5

Line 34, "rotating-operation" should read --rotating operation--.

Signed and Sealed this

Seventh Day of August, 2007

JON W. DUDAS

*Director of the United States Patent and Trademark Office*